US006776143B2

(12) United States Patent
Goodenough et al.

(10) Patent No.: US 6,776,143 B2
(45) Date of Patent: Aug. 17, 2004

(54) FUEL INJECTOR FOR AN INTERNAL COMBUSTION ENGINE

(75) Inventors: Scott A. Goodenough, Kalamazoo, MI (US); Tim D. Haas, Hamburg (DE); Thomas K. Rapp, Besigheim (DE); Aaron M. Jacobs, Grand Rapids, MI (US); Michael T. Dillane, Grand Rapids, MI (US); Gregg R. Spoolstra, Byron Center, MI (US); Daren N. Bolbolan, Shelbyville, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/372,469

(22) Filed: Feb. 21, 2003

(65) Prior Publication Data

US 2003/0159680 A1 Aug. 28, 2003

Related U.S. Application Data

(63) Continuation-in-part of application No. 09/756,369, filed on Jan. 8, 2001, now Pat. No. 6,598,579.

(51) Int. Cl.[7] ..... F02M 37/04

(52) U.S. Cl. ..... 123/495; 123/446; 123/495; 123/514

(58) Field of Search ..... 123/446, 447, 123/457, 458, 510, 511, 514, 495; 239/585.1

(56) References Cited

U.S. PATENT DOCUMENTS

| | | | | |
|---|---|---|---|---|
| 4,036,195 A | | 7/1977 | Bailey | |
| 4,271,806 A | * | 6/1981 | Kaibara et al. | 123/502 |
| 4,531,494 A | | 7/1985 | Bailey et al. | |
| 4,537,352 A | * | 8/1985 | Kato et al. | 239/90 |
| 4,877,055 A | | 10/1989 | Knuchel et al. | |
| 4,962,887 A | * | 10/1990 | Matsuoka | 239/95 |
| 5,901,686 A | | 5/1999 | Stockner et al. | |
| 5,992,768 A | | 11/1999 | Beatty et al. | |
| 6,019,091 A | | 2/2000 | Spoolstra | |
| 6,112,727 A | | 9/2000 | Cristiani et al. | |

* cited by examiner

*Primary Examiner*—Thomas N. Moulis
(74) *Attorney, Agent, or Firm*—Brooks Kushman P.C.

(57) ABSTRACT

A fuel injector pump in a direct-injection fuel delivery system for an internal combustion engine including a solenoid valve for controlling transfer of fluid from a high pressure chamber to a fuel injector nozzle. A supply passage and a return passage provide a fuel flow circuit for the fuel delivery system, the high pressure chamber being defined in part by a camshaft-driven plunger. An independent fuel leak flow path is provided to accommodate fuel leakage past a plunger of the pump, the fuel leak flow path extending to a zero pressure fuel tank.

9 Claims, 7 Drawing Sheets

FUEL INJECTOR FOR AN INTERNAL COMBUSTION ENGINE

CROSS-REFERENCE TO RELATED APPLICATION

This application is a continuation-in-part of application Ser. No. 09/756,369, filed Jan. 8, 2001, now U.S. Pat. No. 6,598,579. That application is assigned to the assignee of this application. The disclosure of application Ser. No. 09/756,369 is incorporated by reference in this application.

BACKGROUND OF THE INVENTION

1. Field of the Invention

The invention relates to a liquid fuel injection system for a direct-injection engine.

2. Background Art

A fuel injector for an internal combustion engine, such as a diesel cycle engine, has a fuel injection pump plunger that reciprocates in a plunger cylinder or bore to effect fuel delivery to nozzles for each of the working cylinders of the engine. The plunger is stroked with a frequency directly proportional to engine speed since it is driven by an engine valve camshaft. The fuel injector includes an electromagnetic solenoid actuator for a fuel control valve, which controls delivery of fuel from a high pressure pumping chamber of the injector to the fuel injection nozzles. The solenoid actuator for the valve may be under the control of a digital electronic engine controller, which distributes controlled current pulses to the actuator to effect metering of fuel from the injector to the nozzles as the injector creates pressure pulses for the injection events.

The camshaft is located in a cylinder housing for the engine where it is exposed to engine lubricating oil. Any fuel that leaks through a clearance between the plunger and the plunger cylinder or bore tends to commingle with the lubricating oil, thereby creating a lubrication oil dilution problem after an extended operating period.

It is possible to reduce leakage past the plunger by reducing the dimensional clearance between the plunger and the plunger cylinder or bore. A reduction in the dimensional clearance, however, increases the risk of plunger seizure. This creates a design problem because mechanical friction losses and increased wear, especially in those instances when the fuel temperature varies throughout a relatively wide temperature range. Furthermore, precise machining required for close tolerance fits between the plunger and the plunger cylinder or bore increases manufacturing costs, which would make such designs impractical for high volume manufacturing operations.

A reduction in lubrication oil dilution can be achieved also by increasing the length of the plunger, thereby increasing the leak flow path length. It has been found, however, that this results only in a moderate decrease in leakage. Further, this would require an undesirable increase in the overall dimensions of the injector. Such increased dimensions of the injector would make it impractical in some commercial engine applications because of packaging constraints as well as cost penalties.

DISCLOSURE OF INVENTION

The present invention is adapted particularly for use with a "dual rail" injector design. That is, fuel is delivered to the injector through a fuel supply rail or passage from a low pressure fuel supply pump. Fuel that is not distributed to the nozzles, which is referred to as spill fuel, is returned to the inlet side of the fuel pump through a separate rail or return flow passage. It is an objective of the invention to reduce engine oil dilution in such a dual rail injector. This is done by decreasing leakage of fuel past the injector plunger into the lubrication oil circuit. This isolates the leak flow path from the region of the engine occupied by the camshaft that drives the injector plunger.

The injector of the invention comprises a fuel pump body with a cylinder that receives the injector pump plunger. A plunger spring normally urges the plunger to a retracted position. The plunger is driven during its working stroke by the engine camshaft.

The plunger and the cylinder or bore define a high pressure pumping chamber that communicates with an injector nozzle through a high pressure fuel delivery passage. Typically, the pressure may be about 20K psi. The high pressure passage is intersected by a pump control valve. Fuel is supplied to the control valve and to the pumping chamber of the injector by a fuel supply pump. The control valve opens and closes the fuel flow path through the high pressure fuel delivery passage in accordance with commands transmitted to a control valve solenoid actuator by an engine controller. The valve is opened and closed at the desired frequency for the injection pulses.

Separate fuel supply and return passages communicate with the control valve and with the pumping chamber. A separate leak-off passage communicates with the injector body and extends to the plunger cylinder at a location intermediate the full stroke position of the plunger and the full retracted position of the plunger. The leak-off passage communicates with a fuel tank, which is under zero gauge pressure. The leak flow path is defined by a predetermined clearance between the plunger and the plunger cylinder. It communicates with the leak-off passage so that leakage fuel will return to the tank rather than flow to the region of the camshaft in the engine cylinder housing. The fuel supply and return circuit is independent of the lubrication oil for the engine so that oil dilution is eliminated or substantially reduced. This increases the durability of the fuel injector and reduces maintenance costs for the engine.

In accordance with one embodiment of the invention, the fuel supply passage communicates with the injector pump body and with an internal passage that communicates with the chamber occupied by the flow control valve. A separate flow return passage in the injector pump body, which sometimes is referred to as a spill passage, communicates with an internal groove that in turn communicates with the return passage. Typically, the spill passage within the injector pump body may have a pressure of about 2K psi.

In a first alternate embodiment of the invention, the return passage is connected to the injector pump body at the upper end of the body adjacent the control valve.

In a second alternate embodiment of the invention, the return passage communicates with the flow control valve through an internal passage in the injector pump body and the supply passage communicates with the region of an actuator for the control valve.

In a third alternate embodiment of the invention, the leak-off passage extends generally in the direction of the axis of plunger cylinder in the pump body. The pump body is mounted in a sleeve in the engine cylinder housing. A leak-off passage fitting on the pump body, as well as a fuel supply passage fitting, are conveniently located externally of the engine cylinder housing.

In each of the embodiments, the leak-off passage is entirely independent of the supply passage and the return passage and is subjected to zero gauge pressure.

DETAILED DESCRIPTION OF THE PREFERRED EMBODIMENTS

Although the disclosed injector is a unit pump, the invention may be used also in a unit injector assembly.

Figure 4:
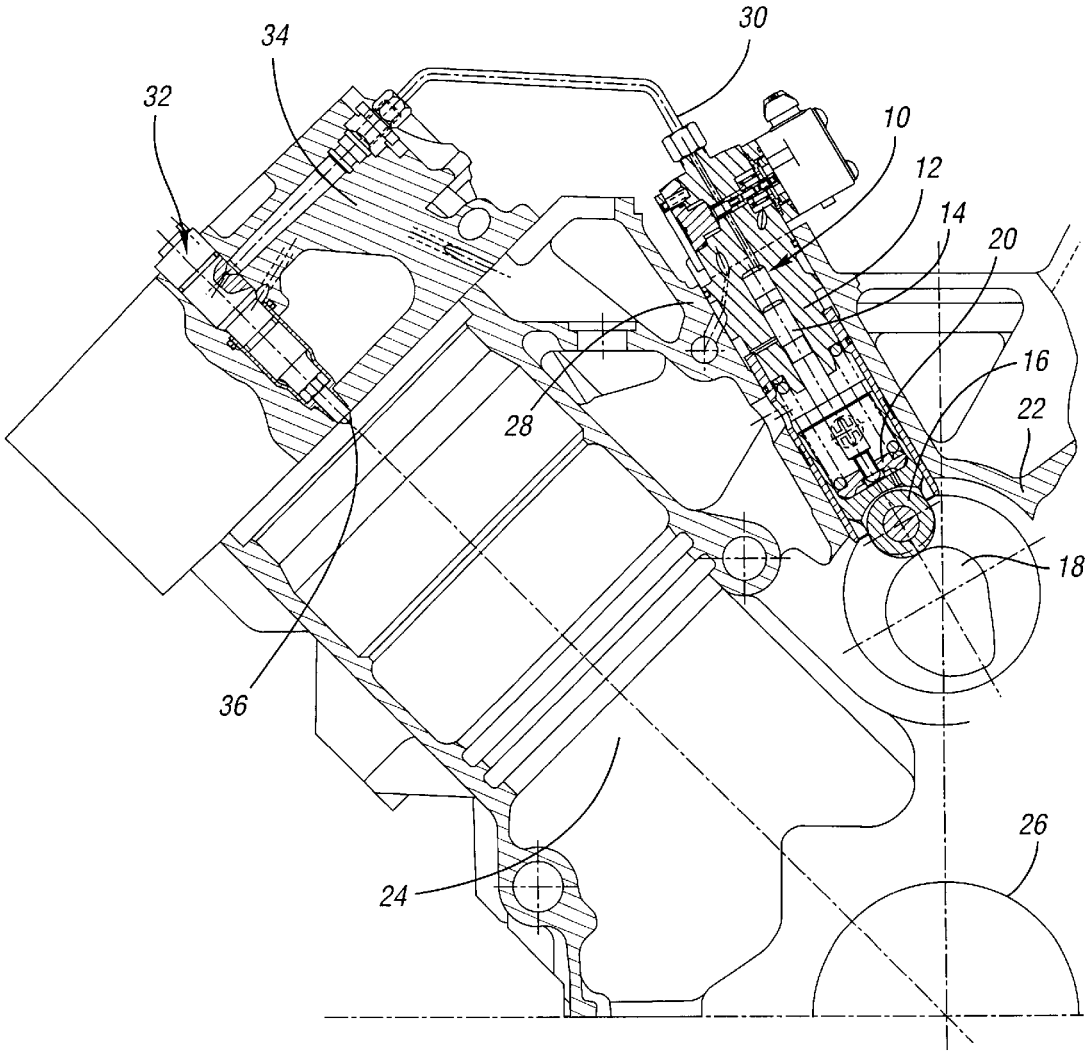
FIG. 4 is a schematic illustration of a portion of a known diesel engine, partly in cross section, which illustrates the overall arrangement of an injector, a camshaft for driving the plunger of the injector, a nozzle and a working cylinder of the engine.

For the purpose of describing an operating environment for an injector incorporating the features of the invention, reference first will be made to FIG. 4, which illustrates a typical installation of a unit pump, mounted on a diesel engine cylinder housing 22. The injector in FIG. 4 is illustrated generally at 10. A plunger 14 is driven by a cam follower 16, which is biased toward an engine camshaft 18 by plunger spring and spring shoulder 20. The camshaft is located in the engine housing 22 adjacent the engine cylinders, one of which is shown at 24. The location of the engine crankshaft is shown at 26.

The engine cylinder housing 22 includes a sleeve 28 in which an injector body 12 is located. A high pressure passage 30 communicates with the injector body 12 and extends to a nozzle assembly 32 in a cylinder head 34. The nozzle assembly includes a nozzle orifice 36 in the combustion chamber of the engine. Engine lubricating oil is in the region occupied by the camshaft 18 and the crankshaft location 26. The lubricating oil is isolated from the injector plunger 14, but any fuel that leaks past the plunger would commingle with the lubricating oil, which would create a dilution problem as previously explained.

Figure 1:
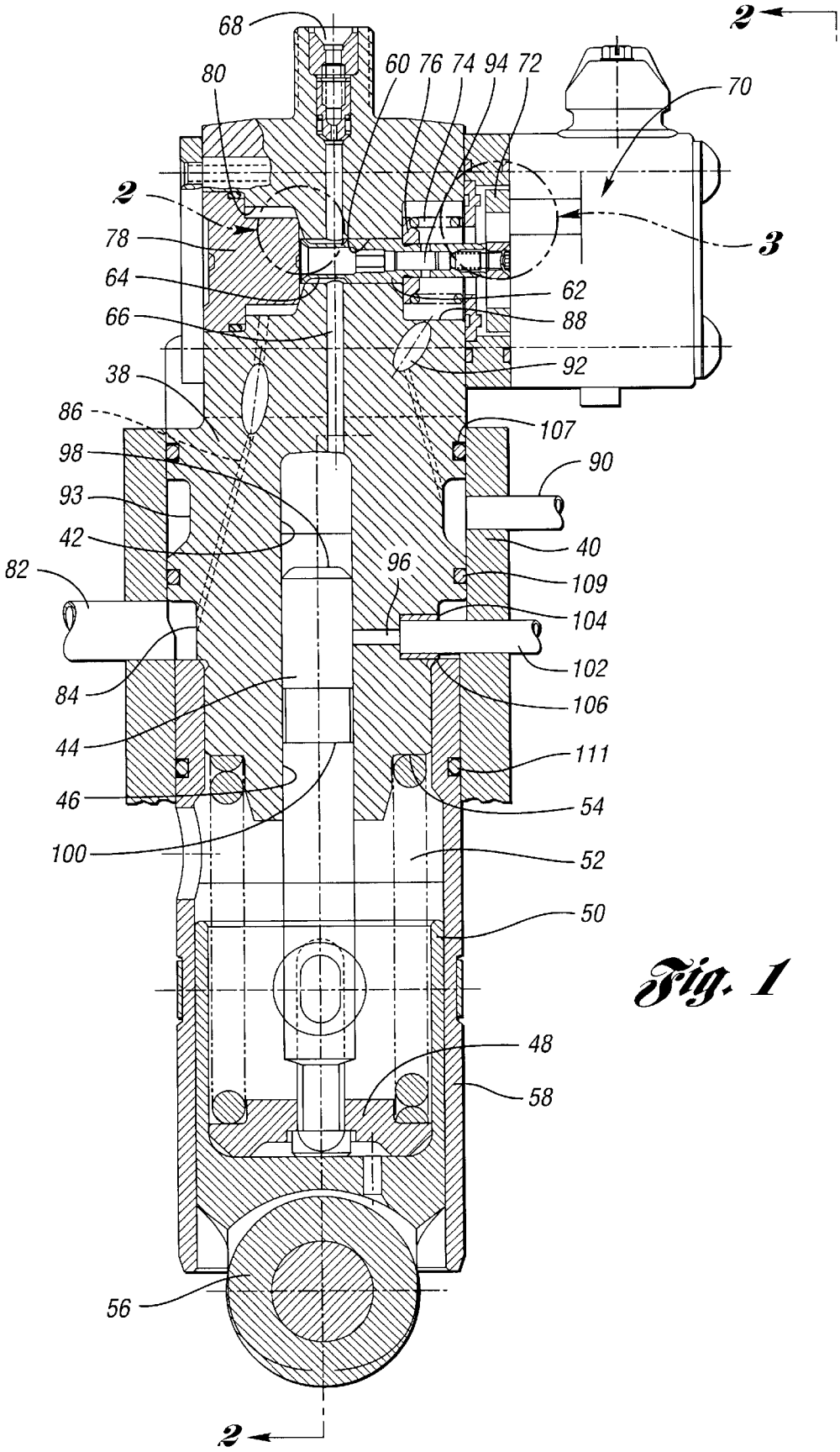
FIG. 1 is a cross-sectional view of an injector embodying the features of the invention.

FIG. 1 shows a first embodiment of the injector pump assembly of the invention. It comprises an injector body 38, which is located in a cylinder housing sleeve 40 corresponding to the sleeve 28 shown in FIG. 4. The injection pump assembly of FIG. 1 includes a pumping chamber 42 defined by reciprocating plunger 44 and plunger cylinder or bore 46. The lower end of the plunger 44 is connected to a spring shoulder 48 received in a spring cage 50. A spring 52 is seated on follower spring seat 54 formed on injector body 38. The plunger normally is urged in a downward direction, as viewed in FIG. 1, by the spring 52. The spring cage 50 carries cam follower 56, which corresponds to the cam follower 16 of FIG. 4. Spring cage 50 is received in sleeve 58 extending from the lower portion of the injector body 38.

A valve chamber 60 is transversely disposed in the injector body 38, its axis being perpendicular to the axis of the plunger. A control valve 62 is situated in the valve chamber 60. An annular groove 64 on the control valve 62 communicates with high pressure passage 66 extending from pumping chamber 42. The passage 66 communicates with outlet fitting 68, which in turn communicates with a high pressure passage corresponding to passage 30 of FIG. 4 and with an injector nozzle.

A solenoid actuator, generally indicated at 70, includes an armature 72, which is connected to the right end of the valve 62. The armature is actuated by a solenoid assembly, not visible in FIG. 1. The valve 62 is urged normally in a left-hand direction, as viewed in FIG. 1, by valve spring 74. Spring 74 is seated on shoulder element 76 carried by valve 62. Valve 62 is spring-loaded normally in a left-hand direction against valve stop 78 received in valve stop chamber 80 in the injector body 38.

The chamber 80 communicates with a fuel return passage 82, which is defined in part by annular groove 84 on the exterior surface of the injector body 38. That communication is established by internal passage 86 formed in the injector body 38.

Spring chamber 88 for spring 74 communicates with inlet passage 90 through internal passage 92. Inlet passage 90 is defined in part by annular groove 93 in the injector body 38. The stop chamber 80 is in fluid communication with the spring chamber 88 through an internal passage, not shown in FIG. 1. Spring chamber 88 also communicates with an internal passage 94 formed in valve 62. When the valve 62 is shifted to its closed position by the actuator 70, internal passage 94 communicates with stop opening 80 and with return passage 82.

A leak-off port 96 formed in injector body 38 extends to the plunger cylinder or bore 46. It intersects the plunger bore 46 at a location intermediate the upper end 98 of plunger 44 and an annular recess shown at 100. The leak-off port 96 communicates with a zero pressure leak-off passage 102 through a fluid fitting 104, which may be held by means of a press-fit in radial opening 106 formed in the injector body 38. The annular recess 100 communicates with port 96 when the plunger is stroked, thereby facilitating flow of leak-off fuel to the zero pressure leak-off passage 102. The leak-off passage 102 extends to a fuel tank, which is under zero gauge pressure.

The supply passage 90 is isolated from other regions of the fluid fuel flow circuit by O-ring seals 107 and 109. Zero pressure leak-off port 96 is sealed from other regions of the system by O-ring seals 109 and 111.

Figure 2:
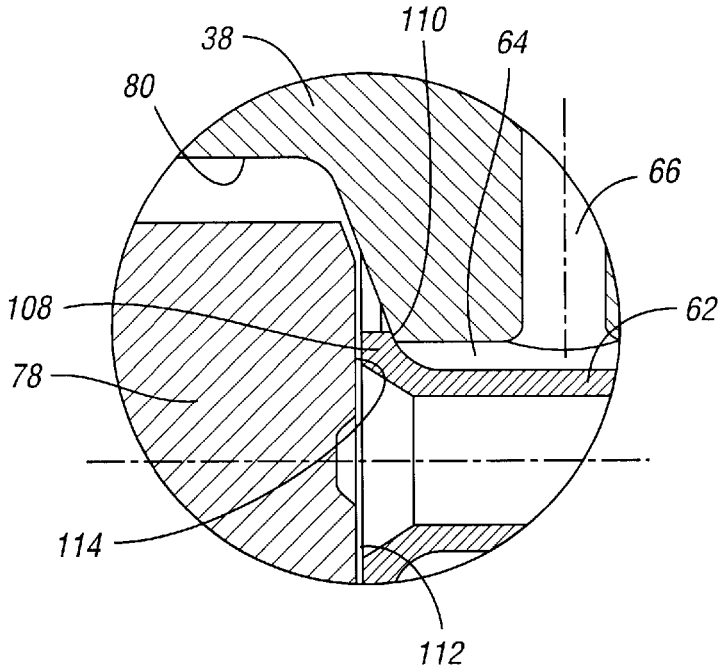
FIG. 2 is an enlargement of a control valve seat for the injector shown in FIG. 1.

FIG. 2 is an enlargement of the left end of the control valve 62. The control valve, as seen in FIG. 2, includes a circular valve land 108, which engages valve seat 110 formed on injector body 38 when the actuator 70 is energized. At that time, a small gap 112 is formed between valve land 108 and surface 114 formed on the stop 78. When the valve 62 is in the position shown in FIG. 2, fuel circulates from the inlet passage 90 through the valve chamber and the spring chamber 88 into the return passage 86 and the return passage 82. When the actuator 70 is deenergized, the valve spring 74 urges the valve 62 in a left-hand direction, thus closing the gap 112 and opening the passage 66 to the flow return circuit.

When the valve 62 is closed, the stroking of the plunger 98 creates a high injection pressure in passage 66, which is delivered to the nozzle as previously explained.

Figure 3:
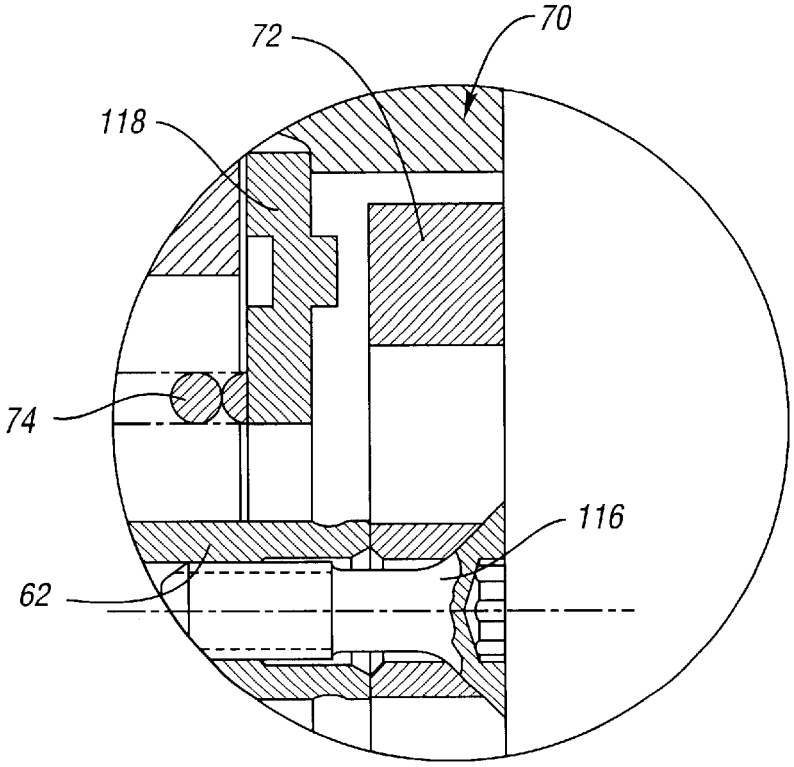
FIG. 3 is an enlargement of the control valve and an electromagnetic solenoid actuator for the control valve for the injector of FIG. 1.

FIG. 3 is an enlargement of the right-hand end of the valve 62. As seen in FIG. 3, the armature 72 is secured to the right-hand end of the valve 62 by threaded connector 116. The right-hand end of the spring 74 is seated on annular spring seat 118, which forms a stationary part of the actuator 70.

Figure 5:
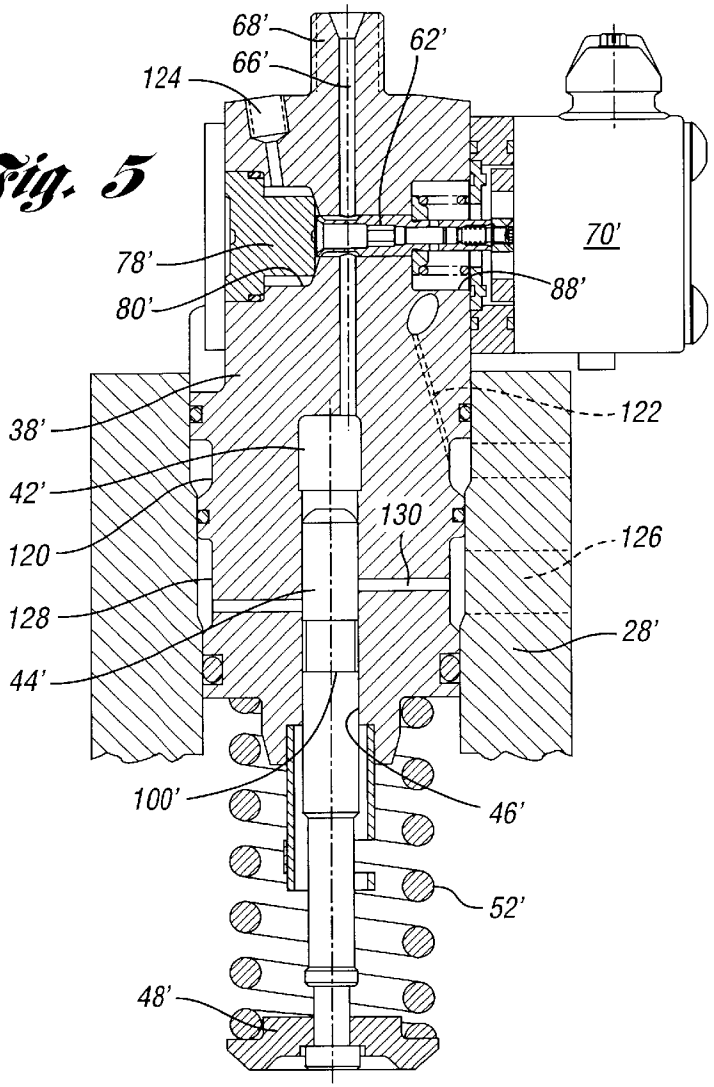
FIG. 5 is a cross-sectional view of a first modified embodiment of the injector of the invention, wherein the flow return passage is located at the top of the injector body.

FIG. 5 shows an alternate embodiment of the invention. It is mounted in engine housing sleeve 28', which corresponds to engine housing sleeve 28 in FIG. 4. In the case of the design of FIG. 5, a fuel supply passage communicates with fuel supply groove 120 formed in injector body 38'. The fuel supply passage communicates through an internal passage 122 with the spring chamber 88', which corresponds to the spring chamber 88 of FIG. 1. The elements of the construction of FIG. 1 that have counterpart elements in the construction of FIG. 5 have been designated by a similar reference numerals, although prime notations are used in FIG. 5.

Unlike the design of FIG. 1 where the flow return passage 82 communicates with a groove formed in the injector body 38, the flow return passage of the design of FIG. 5 is located at the top of the injector body 38', as shown at 124. Communication between the spring chamber 88' in FIG. 5 and the flow return passage 124 in FIG. 5 is established by an internal passage, not shown in FIG. 5. The arrangement of FIG. 5 has packaging advantages, compared to the design in FIG. 1, for certain engine installations.

In FIG. 5, a zero pressure leak-off passage is shown at 126. It communicates with zero pressure drain groove 128 and zero pressure leak-off ports 130. The ports 130 communicate with the plunger chamber 46' at an intermediate location with respect to the upper end of the plunger 44' and annular groove 100'. The ports 130 always are covered by the plunger. They are strategically located at the intermediate position between the high pressure chamber 42' and the region of the engine camshaft that drives the plunger 44' so that leak-off fuel that accumulates in annular groove 100' will drain to the zero pressure passage 126.

Figure 6:
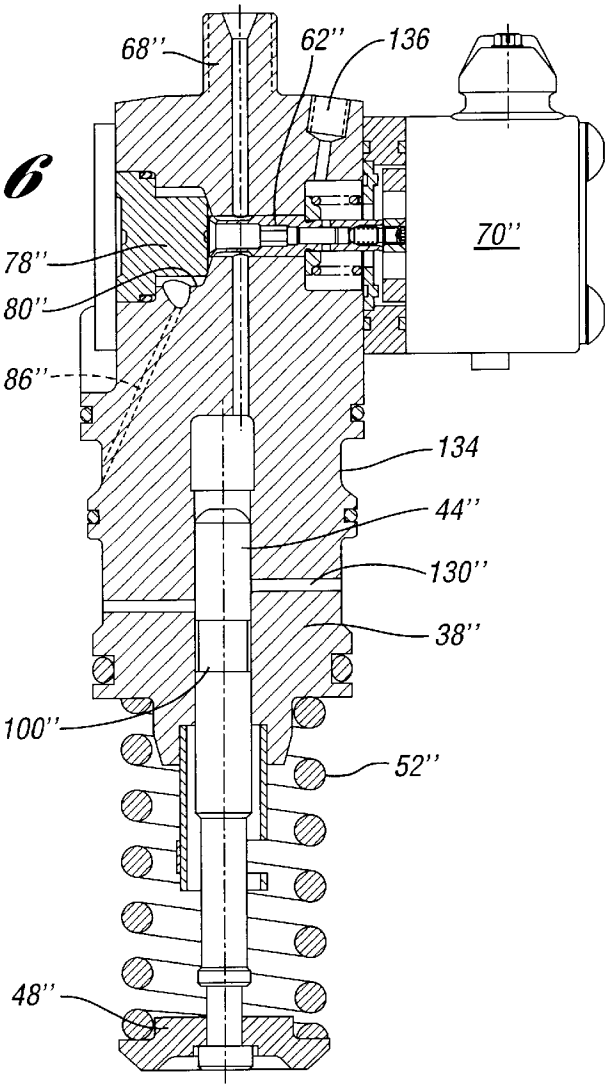
FIG. 6 is a cross-sectional view of a second modified embodiment of the injector of the invention, wherein the fuel supply passage for the injector is located at the top of the injector body adjacent an actuator for the control valve.

In another alternate embodiment, shown in FIG. 6, the zero pressure leak-off ports shown at 130" are located relative to the plunger 44" in a manner similar to the zero pressure port location of FIG. 5. In FIG. 6, elements of the injector that are common to the elements of FIGS. 1 and 5 have been designated by similar reference numerals, although double prime notations are used.

In the design of FIG. 6, the return passage communicates with a return annular groove 134 in the injector body 38". A fuel supply passage, unlike the fuel supply passage of the design of FIG. 5, is located at the top of the injector body 38", as shown at 136. The modes of operation of the embodiments of FIGS. 1, 5 and 6 are essentially the same.

The location of the supply passage in the embodiment of FIG. 5 is similar to the location of the supply passage 90 in the embodiment of FIG. 1. The location of the return passage of the design in FIG. 6 is similar to the location of the supply passage for the design of FIG. 5 and the design of FIG. 1. The zero pressure leak-off ports for the three designs are located in a similar fashion with respect to the plunger bore.

Figure 7:
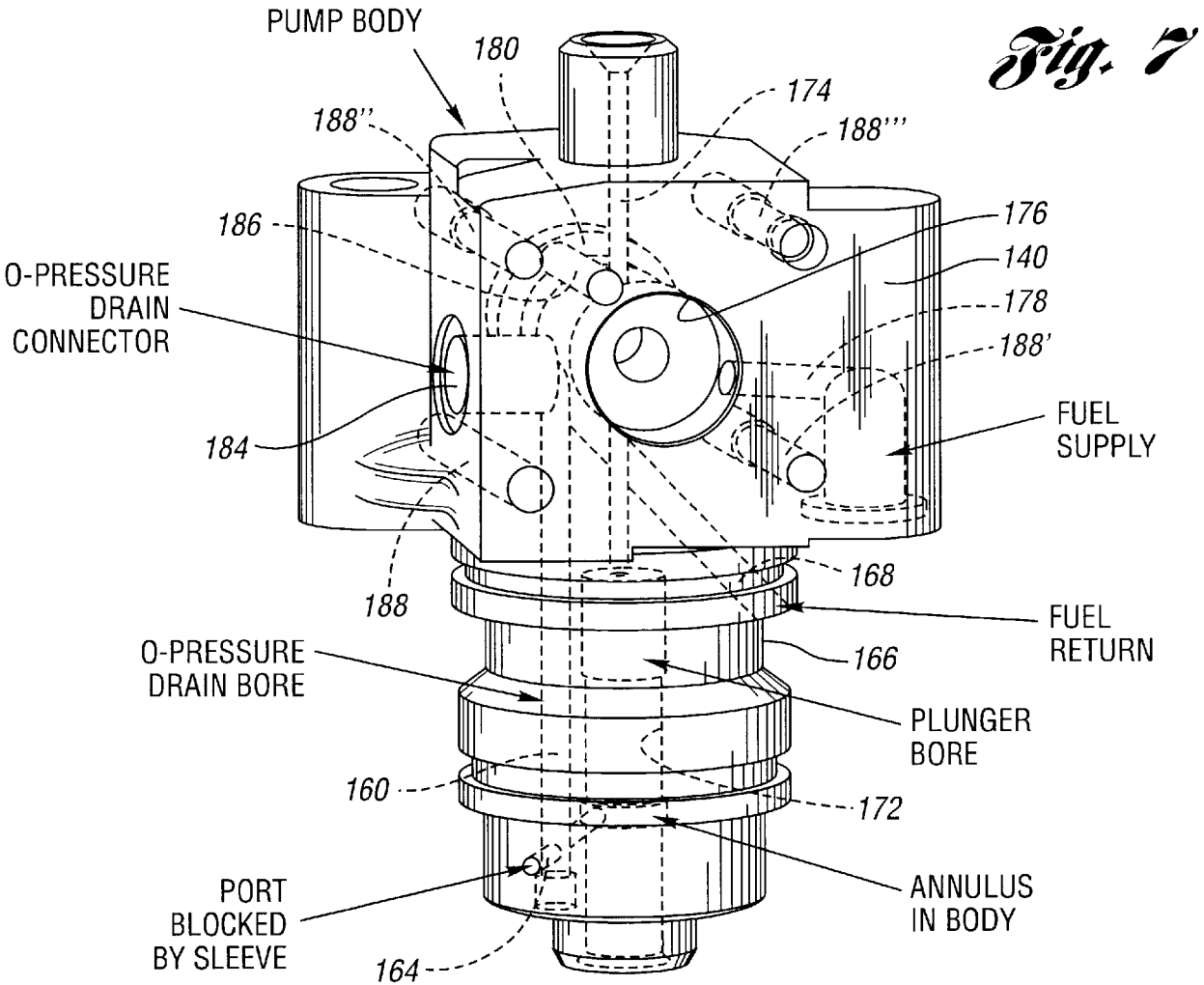
FIG. 7 is an isometric view of a third modified embodiment of the invention with internal passages shown in phantom.
Figure 8:
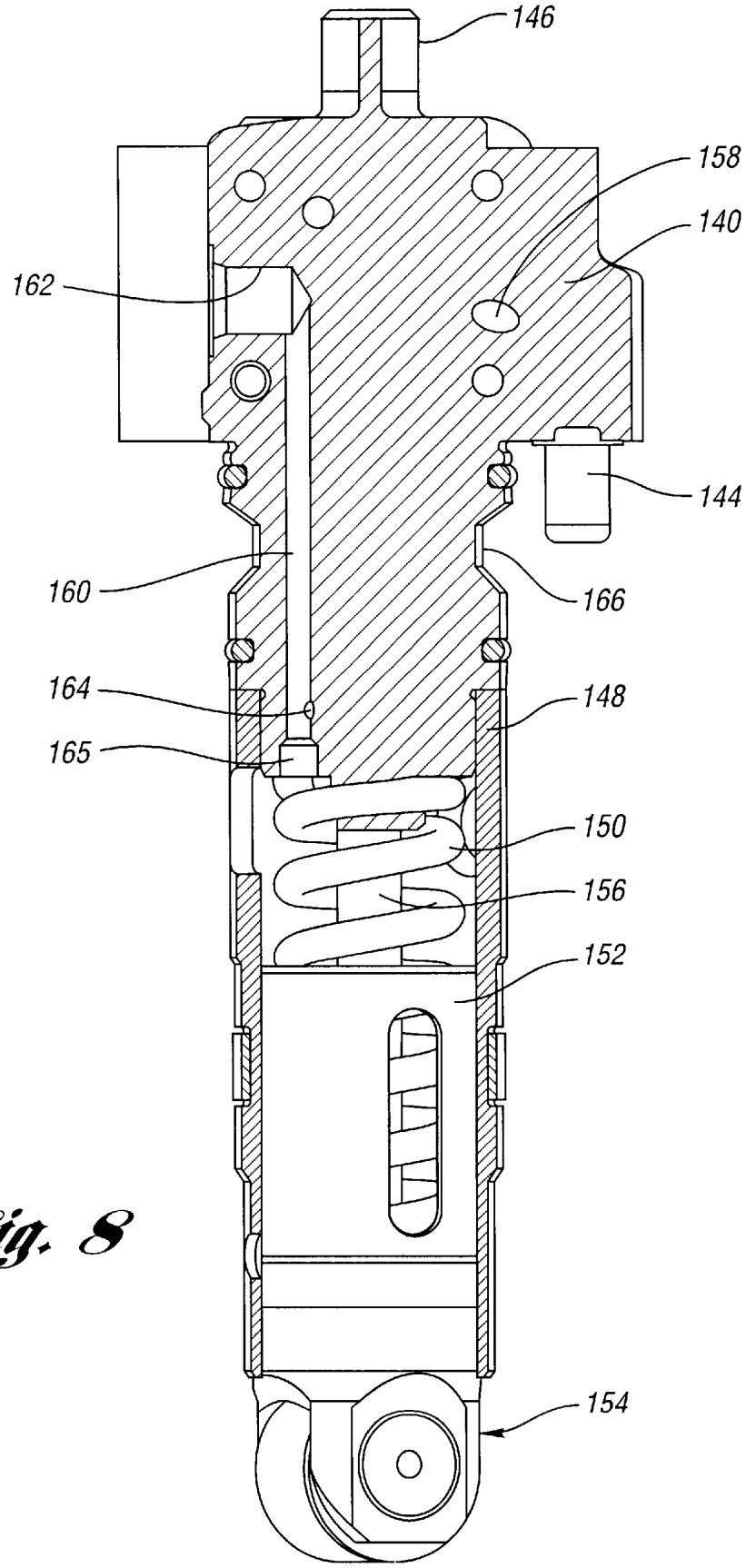
FIG. 8 is a cross-sectional view of the modified unit pump shown in FIG. 7; and, FIG. 9 is a cross-sectional view of the modified unit pump shown in FIG. 7, the plane of the cross-section being angularly offset from the plane of the cross-section of FIG. 8.
Figure 9:
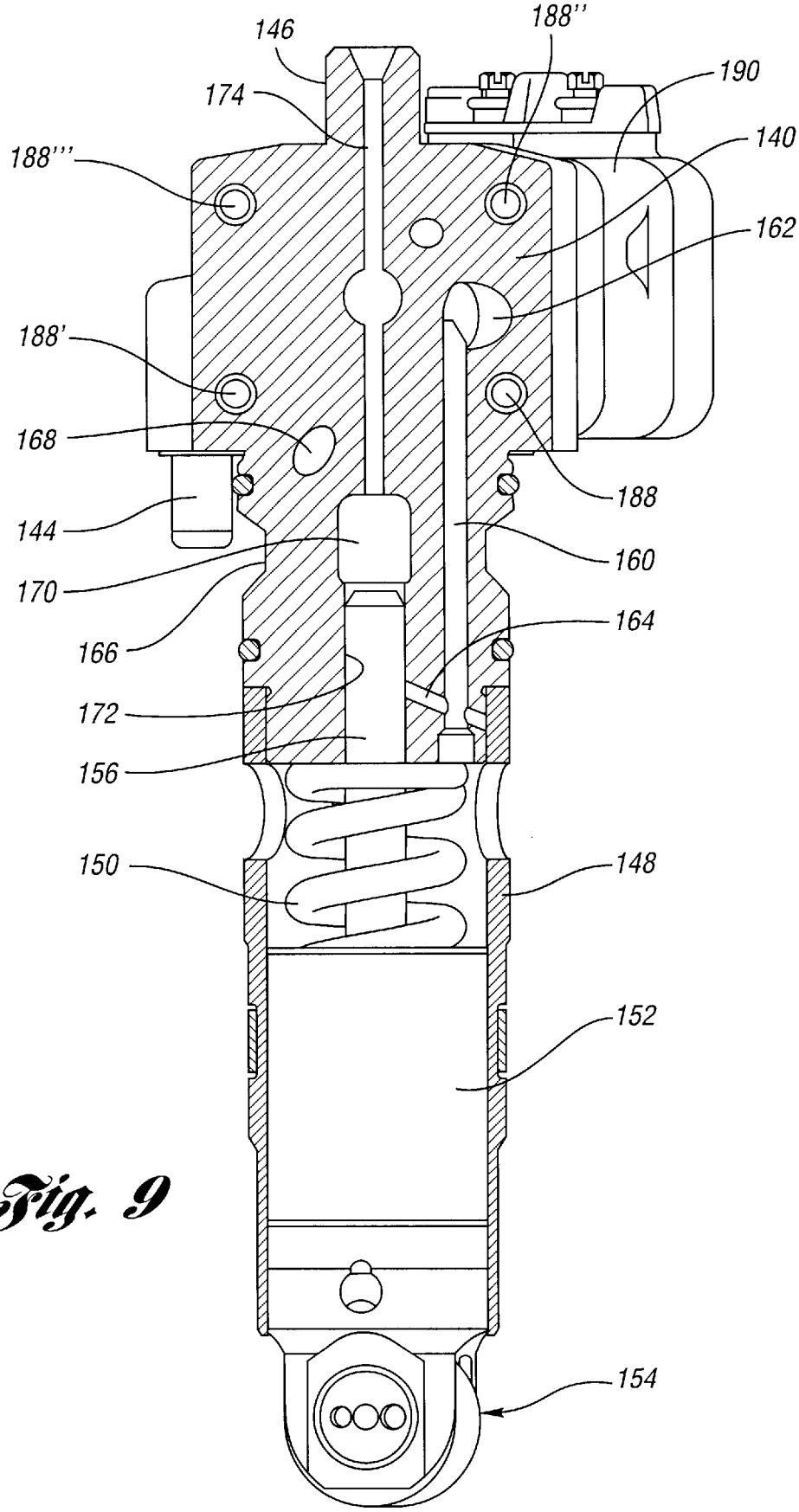

FIGS. 7, 8 and 9 illustrate a further embodiment of the invention. It is adaptable for assembly in an engine cylinder housing of the kind shown, for example, in FIG. 4, without the necessity for modifying the engine cylinder housing. The unit pump illustrated in FIG. 4 readily may be replaced with the unit pump shown in FIGS. 7, 8 and 9. Thus the zero leak pressure leak-off passage or leak flow passage feature of the embodiment shown in FIGS. 1, 5 and 6 can be incorporated in the same engine casting shown in FIG. 4 by using the unit pump of FIGS. 7, 8 and 9. The zero pressure leak flow passage of the design in FIGS. 7, 8 and 9 does not require special machining of the engine casting to create a fluid flow path from the unit pump to a zero pressure fuel tank.

As seen in FIG. 8 the unit pump of the further embodiment of the invention comprises an injector body 140, which is formed with fuel flow inlet fitting 144. A high pressure flow outlet fitting 146 is formed on the upper end of body 140. The lower end of body 140 is received in the upper end of a sleeve 148, which encloses a plunger spring 150. A spring cage 152 is slidably received in the sleeve 148. The lower end of the spring cage 152 is connected to a cam follower, generally indicated in FIG. 8 by numeral 154. This cam follower would correspond to the cam follower 56 of the FIG. 1 embodiment.

The cam follower 154 is connected to a plunger 156, which is received in a plunger cylinder or bore formed in the body 140. The bore is not shown in FIG. 8 since it is located out of the plane of the cross section of FIG. 8.

A portion of a fluid inlet passage extending from the fitting 144 to a valve chamber in the body 140 is shown at 158. A zero pressure leak flow passage 160 extends in a vertical direction through the body 140. At its upper end, the leak flow passage 160 communicates with a leak flow fitting opening 162. The lower end of the leak flow passage 160 communicates with a zero pressure leak flow port 164, which extends in a generally radial direction toward the centerline of the plunger cylinder or bore that receives plunger 156. The lower end of the passage 160 is closed by a plug in plug opening 165. The radially outward end of the port 164 is blocked by the sleeve 148, best seen in FIG. 9.

The port 164 corresponds to the port 96 of the FIG. 1 embodiment, ports 130 of the FIG. 5 embodiment and ports 130" of the FIG. 6 embodiment. The port 164 is best seen by referring to FIG. 9, which illustrates the intersection of the port 164 with the zero pressure leak flow passage 160.

A return flow groove is shown in FIGS. 7, 8 and 9 at 166. A portion of the return flow passage in the body 140, which communicates with the groove 166, is shown in FIGS. 7 and 9 at 168.

FIG. 9 shows the high pressure pumping chamber or cavity 170 at the upper end of plunger cylinder or bore 172. Chamber 170 communicates with the high pressure outlet fitting 146 through internal high pressure passage 174.

The valve chamber for the design of FIGS. 7, 8 and 9 is best seen in FIG. 7 at 176. A fuel supply passage 178 extends to the interior of the valve chamber 176 and is connected to the fuel inlet flow fitting 144, seen in FIGS. 8 and 9. The valve chamber receives a valve assembly corresponding to the valve assembly of FIGS. 1, 5 and 6. A large diameter portion of the valve chamber defines a valve spring chamber that corresponds to the spring chamber 88 of FIG. 1 and the spring chamber 88' of FIG. 5. The end of the valve chamber opposite to the valve spring chamber defines a stop chamber, partially shown in phantom in FIG. 7 at 180. As in the case of the embodiments of FIGS. 1, 5 and 6, the stop chamber 180 receives a valve stop that corresponds to the valve stop 78 of FIG. 1, stop 78' of the FIG. 5 embodiment and stop 78" of the FIG. 6 embodiment. Stop chamber 180 surrounds the stop and communicates with the fuel return groove 166 through the internal passage best seen in FIG. 7 at 168.

The zero pressure leak flow passage 160 communicates with a zero pressure connector, partially shown in FIG. 7 at 184, which is received in zero pressure leak flow fitting opening 162, seen in FIG. 8.

Seen in FIG. 7 is a crossover passage 186, which connects the chamber 180 surrounding the valve stop with the valve spring chamber at the opposite end of the valve chamber 176.

Seen also in FIG. 7 are mounting bolt openings 188, 188', 188" and 188"', which secure a solenoid actuator assembly, not shown in FIGS. 7 and 8 but which is generally indicated by reference number 190 in FIG. 9.

An advantage of the design of FIGS. 7, 8 and 9 is its adaptability for use with an existing cast engine housing without requiring modifications to the engine housing. The zero pressure leak flow feature can be used advantageously with an engine for a vehicle that requires long idle periods. The same engine can be used in other heavy duty vehicles intended for high power, continuous operation at highway speed with a relatively low percentage idle time where the need for a flow feature is of lesser importance.

The zero pressure leak flow feature is more advantageous when the engine is used with a high percentage of idle time or when the vehicle has frequent stops and starts as in the case of urban transit vehicles; e.g., busses and garbage trucks. If the same engine is used with highway transit vehicles in which the largest percentage of operating time is at advanced throttle and at continuous highway speeds, the opportunity for lubricating oil dilution is reduced since the high pressures developed in the injector pumping chamber typically would result in a slight injector body distortion or strain in a radial direction in the region of the high pressure pumping chamber. This condition would result in a reduction in clearance for the plunger at locations in the plunger bore near the cam follower assembly, thereby tending to reduce leakage.

Although selected embodiments of the invention have been disclosed, it will be apparent to persons skilled in the art that modifications may be made without departing from the scope of the invention. Such modifications and equivalents thereof are intended to be covered by the following claims.

What is claimed is:

1. A fuel injection pump assembly for an internal combustion engine comprising an injector body defining a cylindrical fuel pumping chamber, a plunger mounted for reciprocation in the pumping chamber, a high pressure fuel delivery passage extending from the pumping chamber to an injector nozzle;

a control valve in the fuel delivery passage, an actuator for the control valve for establishing and interrupting delivery of fuel from the pumping chamber to the injector nozzle;

a cam mechanism driven by the engine including a cam drivably engageable with the plunger whereby the cam mechanism strokes the plunger in a stroking direction to effect high pressure fuel delivery to the injector nozzle, the cam mechanism being in communication with lubrication oil in the engine;

a fuel supply passage in the injector body communicating with the control valve;

a flow return passage in the injector body communicating with the control valve;

a zero pressure leak flow passage in the injector body;

the zero pressure leak flow passage being independent and separate from the fuel supply passage and the fuel return passage;

at least one fuel leak flow port in the pump body communicating with the pumping chamber and located relative to the plunger whereby it is covered by the plunger as the plunger is stroked, the leak flow port extending to the zero pressure leak flow passage;

the plunger displacing fuel in the pumping chamber as fuel is delivered by the high pressure fuel delivery passage to the injector nozzle; and a predetermined dimensional clearance between the plunger and the pumping chamber defining a leak flow path leading to the leak flow port from the pumping chamber as the plunger is advanced in a pumping stroke by the cam mechanism, thereby avoiding mixing of fuel with engine lubrication oil.

2. The fuel injection pump assembly set forth in claim 1 wherein the actuator for the control valve comprises a solenoid forming a part of an electronic controller responsive to engine operating variables for establishing fuel flow from the pumping chamber through the control valve to the high pressure fuel delivery passage when the control valve is moved by the actuator to a closed position and establishing fuel flow from the fuel supply passage through the control valve to the pumping chamber when the valve is moved to an open position.

3. The fuel injection pump assembly set forth in claim 1 wherein the leak flow path is defined in part by a flow path created by the predetermined dimensional clearance, the zero pressure leak flow passage extending to a fuel supply tank.

4. The fuel injection pump assembly set forth in claim 1 wherein the leak flow path is defined in part by an annulus formed in the plunger, the annulus communicating with the leak flow port as the pump plunger is stroked by the cam mechanism whereby fuel leakage around the pump plunger escapes through the leak flow port.

5. The fuel injection pump assembly set forth in claim 2 wherein the leak flow path is defined in part by an annulus formed in the pump plunger, the annulus communicating with the leak flow port as the pump plunger is stroked by the cam mechanism whereby fuel leakage around the pump plunger escapes through the leak flow port.

6. The fuel injection pump assembly set forth in claim 3 wherein the leak flow passage is defined in part by an annulus formed in the pump plunger, the annulus communicating with the leak flow port as the pump plunger is stroked by the cam mechanism whereby fuel leakage around the pump plunger escapes through the leak flow port.

7. The fuel injection pump assembly set forth in claim 1 wherein the engine comprises an engine housing configured to support the injector body, the zero pressure leak flow passage extending from the leak flow port through the injector body to a leak flow outlet location on the injector body that is external of the engine housing.

8. The fuel injection pump assembly set forth in claim 7 wherein the zero pressure leak flow passage extends from the leak flow port through the injector body in a direction that is generally parallel to the stroking direction of the plunger.

9. The fuel injection pump assembly set forth in claim 8 including a zero pressure leak flow passage connector at the leak flow outlet location whereby leak flow is returned through a conduit to a zero pressure tank.

* * * * *

UNITED STATES PATENT AND TRADEMARK OFFICE

CERTIFICATE OF CORRECTION

PATENT NO. : 6,776,143 B2
APPLICATION NO. : 10/372469
DATED : August 17, 2004
INVENTOR(S) : Scott A. Goodenough et al.

It is certified that error appears in the above-identified patent and that said Letters Patent is hereby corrected as shown below:

Claim 1, column 8, line 1: Delete "pump" and insert -- injector --.

Signed and Sealed this

Twenty-fifth Day of August, 2009

David J. Kappos

David J. Kappos
*Director of the United States Patent and Trademark Office*